US005113119A

United States Patent [19]

Niemann et al.

[11] Patent Number: 5,113,119

[45] Date of Patent: May 12, 1992

[54] HIGH PRESSURE GAS DISCHARGE LAMP

[75] Inventors: Ulrich Niemann; Stephan Offermanns, both of Aachen; Bernhard Weber, Hilden, all of Fed. Rep. of Germany

[73] Assignee: U.S. Philips Corporation, New York, N.Y.

[21] Appl. No.: 576,322

[22] Filed: Aug. 29, 1990

[30] Foreign Application Priority Data

Sep. 26, 1989 [DE] Fed. Rep. of Germany ..... 3932030

[51] Int. Cl.[5] ..... H01J 17/20; H05B 41/24

[52] U.S. Cl. ..... 313/638; 313/642; 313/643; 315/248

[58] Field of Search ..... 313/595, 638, 642; 315/248; 445/26

[56] References Cited

U.S. PATENT DOCUMENTS

| | | | |
|---|---|---|---|
| 3,319,119 | 5/1967 | Rendina | 313/572 |
| 3,385,645 | 5/1968 | Smith | 445/26 |
| 3,720,855 | 3/1973 | Gardner et al. | 313/571 |
| 4,705,987 | 11/1987 | Johnson | 313/634 |
| 4,783,615 | 11/1988 | Dakin | 313/642 |

FOREIGN PATENT DOCUMENTS 0967658 7/1949 Fed. Rep. of Germany .

*Primary Examiner*—Donald J. Yusko
*Assistant Examiner*—Diab Hamadi
*Attorney, Agent, or Firm*—Brian J. Wieghaus

[57] ABSTRACT

An electrodeless high pressure discharge lamp contains a halide or oxyhalide of W, Ta, Re, or rhenium oxide in such a quantity that a supersaturated metal vapor arises in the discharge, by which metal particles are formed. Owing to their high temperature these particles generate thermal emission. The lamp has a high color temperature and a high color rendering index.

8 Claims, 4 Drawing Sheets

HIGH PRESSURE GAS DISCHARGE LAMP

BACKGROUND OF THE INVENTION

The invention relates to a high pressure gas discharge lamp having a bulb and a filling which contains a starting gas and a metal compound in such a quantity that in the operational condition of the lamp condensed metal particles are forced which generate light by incandescent emission.

Such a high pressure gas discharge lamp provided with electrodes is known from DE-PS 967 658. Along the metal compounds used are oxides and halides of tungsten and rhenium. This Patent describes how a number of the metals listed show a strong, continuous spectrum in the visible range and in the long-wave UV range, especially at higher vapour pressures, so that these metals can be regarded as economic light sources for pure white light. It is also described that some low-volatility, emitting metals can be subject to partial condensation into airborne particles, which then leads to a desired reinforcement of the continued. The metal is returned to its compound in the colder regions of the discharge vessel.

The inner electrodes of the known high pressure gas discharge lamp, however, are attacked by the halides and destroyed in a relatively short period. The oxides cause oxidation of the electrodes, the metal being deposited on the wall of the discharge vessel, so that it does not take part in the discharge anymore. In either case, the result is a very short useful life of the high pressure gas discharge lamp. Moreover, a low degree of condensation in the discharge arc is achieved in the presence of electrodes, because the metal condenses mostly on the relatively cold electrodes.

US-PS 37 20 855 discloses an electrodeless gas discharge lamp having a filling containing an oxytrihalide of vanadium, niobium, or tantalum. The quantity of oxyhalide can have a partial pressure of up to 266 mbar. The lamp emits a line spectrum.

SUMMARY OF THE INVENTION

The invention has for its object inter alia to provide a high pressure gas discharge lamp which generates particles to the type described in the opening paragraph and which has a long useful life.

According to the invention, this object is achieved in that the lamp has no electrodes and contains a metal compound chosen from the group consisting of tungsten, rhenium and tantalum halide, tungsten, rhenium, and tantalum oxyhalide, and rhenium oxide, in which lamp the quantity of metal is at least 0.02 mg/cm$^3$ bulb volume in the case of a r rhenium compound, and at least 0.4 mg/cm$^3$ in the case of a tantalum compound.

It is usual to excite such an electrodeless high pressure gas discharge lamp with a high frequency of between 0.1 MHz and 50 GHz. The bulb interior of such a lamp does not contain any metal parts which could be attacked by the metal compounds. In order to safeguard a sufficient particle formation for the thermal light generation, the quantity of metals in the discharge must be great in comparison to known discharge lamps. Indeed, the metal in the shape of a volatile compound is to be brought into the gas phase from the bulb wall in such great quantities that the partial pressure of the metal is above the saturation vapour pressure after the dissociation of the compound in the discharge. Under these conditions a nucleation is spontaneously initiated and particles with a size of between 0.3 nm and 500 um will condense. The temperature of the particles is between 3000 and 4500 K, so that they show thermal emission.

The elements rhenium, tungsten and tantalum are the metals with the highest boiling points. These metals are still solid or liquid at 3000–4500 K, which is important for the formation of effective light emitting particles. The lives achieved by these lamps are in excess of 100 hours. Lamps with lamp lives of more than 1000 hours were obtained. The life of a high pressure discharge lamp having electrodes and a similar filling, on the other hand, is less than 1 hour.

The most suitable halides or oxyhalides are broaine, chlorine, and iodine compounds. Rhenium oxide can be applied as $Re_2O_7$, $ReO_3$ or $ReO_2$, or a mixture of these oxides. Rhenium oxide has the particular advantage that it reacts with none of the known light transmitting bulb materials (quartz glass, aluminum oxide, yttrium-aluminum garnet). The life of this lamp, therefore, is not limited by chemical corrosion.

The filling may contain further metals or metal compounds, for instance alkali metal halides, to stabilize the discharge and/or control the plasma temperature.

The lamp filling usually contains a rare gas by way of starting gas with a cold filling pressure below 20 mbar. The rare gas portion, however, can also be used to stabilize and/or control the plasma temperature. In that case, though, the filling pressure at room temperature must be more than 20 mbar, for example above 50 mbar.

In a further embodiment of the high pressure gas discharge lamp according to the invention, the bulb filling contains rhenium heptoxide and xenon, the xenon filling pressure at room temperature being above 20 mbar, for example above 50 mbar. This lamp has the Particular advantage that it contains exclusively substances which do not react with known light transmitting bulb materials. The life of this lamp is consequently very long. The use of xenon is additionally advantageous since the luminous efficacy is higher than is the case with fillings containing other rare gases.

BRIEF DESCRIPTION OF THE DRAWINGS

Embodiments of the lamp according to the invention will now be described in more detail with reference to the drawings, in which.

DESCRIPTION OF THE PREFERRED EMBODIMENTS

Figure 1:
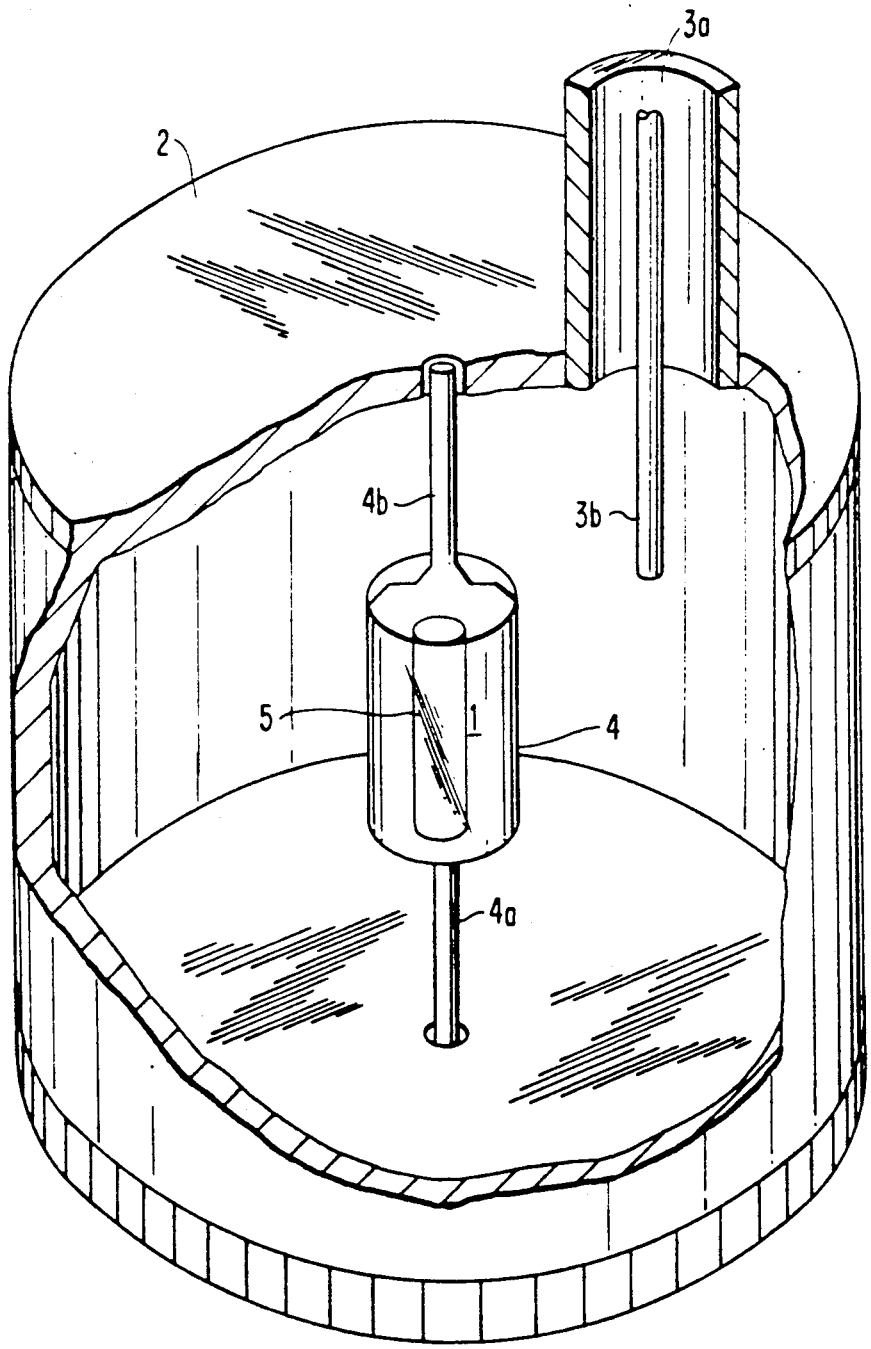
FIG. 1 shows an electrodeless high pressure gas discharge lamp having a cylindrical bulb inside a microwave resonator.

FIG. 1 shows an electrodeless high pressure gas discharge lamp 1 inside a microwave cavity resonator 2, which is fed with a frequency of 2.45 GHz through a coaxial exciter antenna 3*a* 3*b*. The excitation power is between 80 and 120 W. The high pressure discharge lamp 1 has a cylindrical bulb 4 made of quartz glass with an interior diameter of 5 mm and an interior length of 13 mm, which provides a bulb volume of 0.25 cm$^3$. The bulb is filled with a starting gas and a metal compound.

The bulb is supported within the resonator 2 by elongate quartz seals 4a, 4b of the bulb 4. The discharge occurring in the lamp 1 under the influence of the microwave excitation is indicated by the darker region 5.

Figure 2:
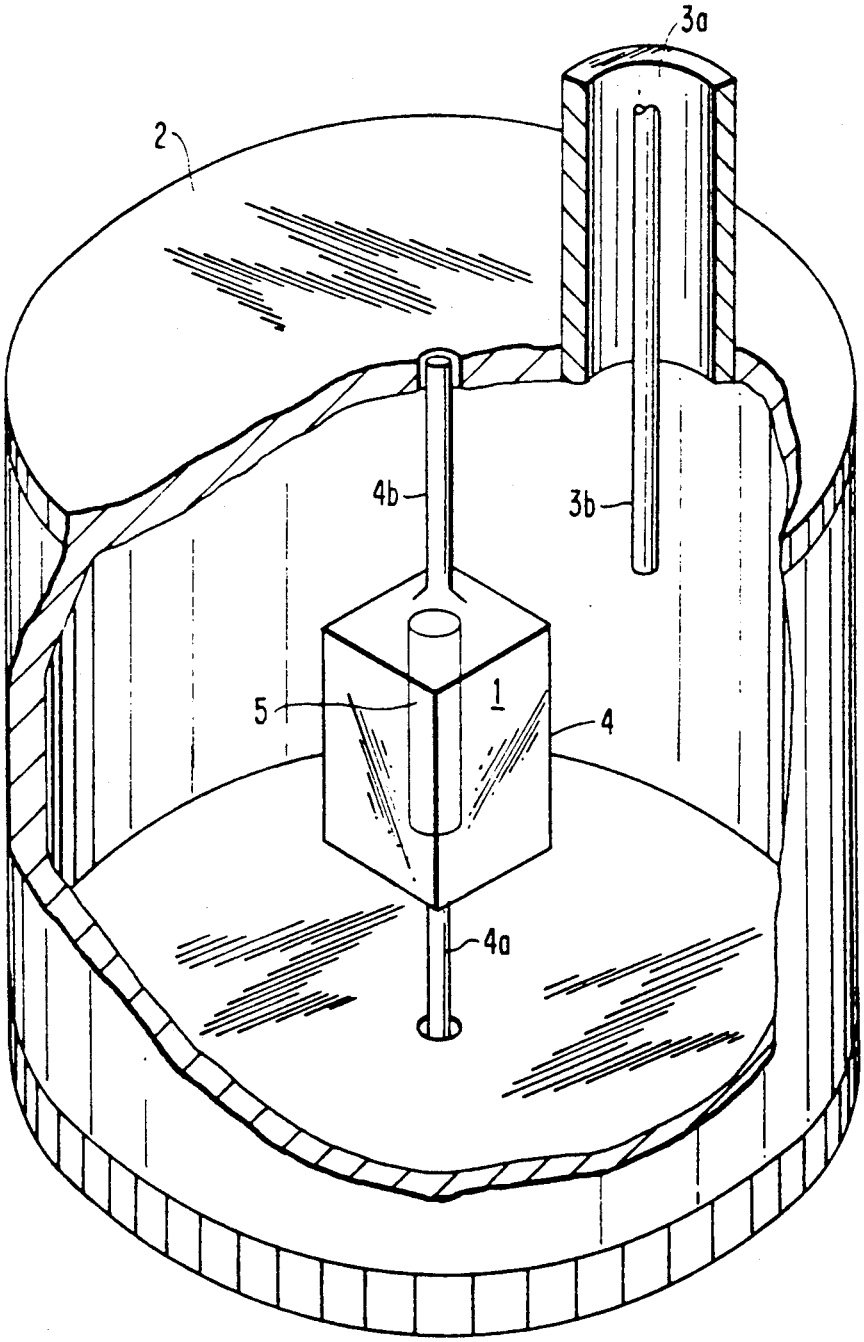
FIG. 2 shows an electrodeless high pressure gas discharge lamp having a cuboid bulb, also inside a microwave resonator.

The high Pressure gas discharge lamp of FIG. 2 differs from the one of FIG. 1 basically in that it has a cuboid bulb 4 with a length of 16 mm and a lateral width of 10 mm, which corresponds to a quadratic cross-section of 100 $mm^2$. Total bulb volume thus is 1.6 $cm^3$.

In the embodiments listed below, the bulb fillings and the lamp characteristics achieved with them are given for a number of lamps according to FIG. 1.

EXAMPLE 1

| | |
|---|---|
| Filling | 0.40 mg $WO_2Br_2$ |
| | 0.02 mg CsBr |
| | 10 mbar Ar/Kr mixture |
| Metal in gas phase | 0.8 mg/$cm^3$ W |
| Electric power | 80 W |
| Luminous efficacy | 59 lm/W |
| Colour temperature | 5580 K |
| Colour rendering index $R_a$ | 95 |
| Wall temperture | 940° C. |

EXAMPLE 2

| | |
|---|---|
| Filling | 0.40 mg $WO_2Cl_2$ |
| | 0.01 mg NaCl |
| | 10 mbar Ar/Kr mixture |
| Metal in gas phase | 1.0 mg/$cm^3$ W |
| Electric power | 80 W |
| Luminous efficacy | 67 lm/W |
| Colour temperature | 5150 K |
| Colour rendering index $R_a$ | 92 |
| Wall temperture | 880° C. |

Figure 3:
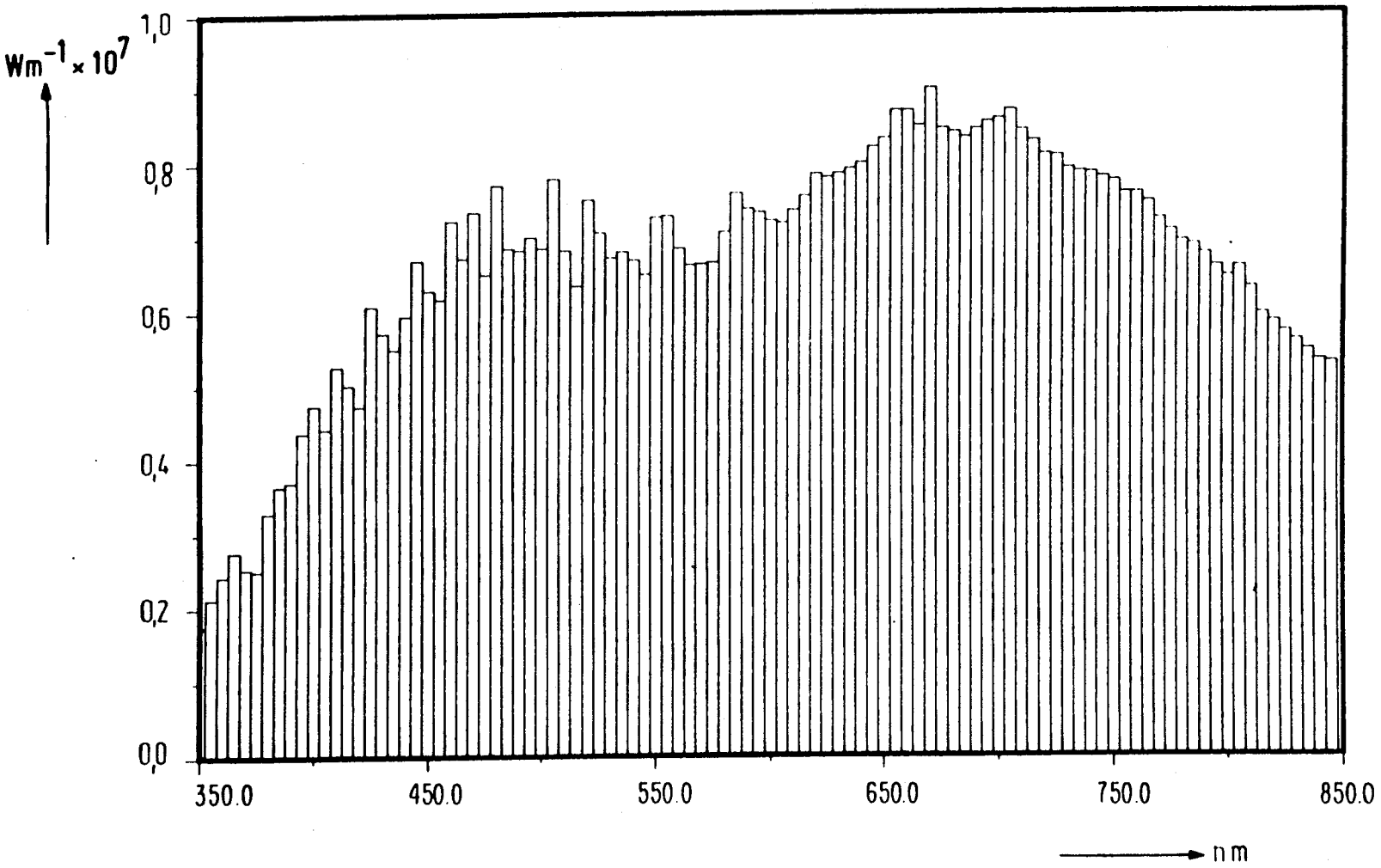
FIGS. 3 and 4 show light spectra as the spectral radiant flux Plotted against the wavelength for two of the embodiments of the high pressure gas discharge lamps described in more detail below.

The spectrum of the light radiated by this lamp is given in FIG. 3, in which the spectral radiant flux in $W \cdot m^{-1}$ is plotted against the wavelength in nm.

EXAMPLE 3

| | |
|---|---|
| Filling | 0.40 mg $WO_2Cl_2$ |
| | 0.02 mg CsCl |
| | 10 mbar Ar/Kr mixture |
| Metal in gas phase | 1.0 mg/$cm^3$ W |
| Electric power | 80 W |
| Luminous efficacy | 57 lm/W |
| Colour temperature | 3870 K |
| Colour rendering index $R_a$ | 92 |
| Wall temperture | 935° C. |

EXAMPLE 4

| | |
|---|---|
| Filling | 0.40 mg $WCl_6$ |
| | 0.02 mg CsCl |
| | 10 mbar Ar/Kr mixture |
| Metal in gas phase | 0.7 mg/$cm^3$ W |
| Electric power | 80 W |
| Luminous efficacy | 49 lm/W |
| Colour temperature | 4290 K |
| Colour rendering index $R_a$ | 91 |
| Wall temperture | 1100° C. |

EXAMPLE 5

| | |
|---|---|
| Filling | 0.30 mg $TaOCl_2$ |

-continued

| | |
|---|---|
| | 0.20 mg Hg |
| | 10 mbar Ar/Kr mixture |
| Metal in gas phase | 0.8 mg/$cm^3$ Ta |
| Electric power | 80 W |
| Luminous efficacy | 35 lm/W |
| Colour temperature | 8500 K |
| Colour rendering index $R_a$ | 86 |
| Wall temperture | 900° C. |

EXAMPLE 6

| | |
|---|---|
| Filling | 0.50 mg $Re_2O_7$ |
| | 133 mbar Xe |
| Metal in gas phase | 1.5 mg/$cm^3$ Re |
| Electric power | 120 W |
| Luminous efficacy | 65 lm/W |
| Colour temperature | 5305 K |
| Colour rendering index $R_a$ | 94 |
| Wall temperture | 1050° C. |

Figure 4:
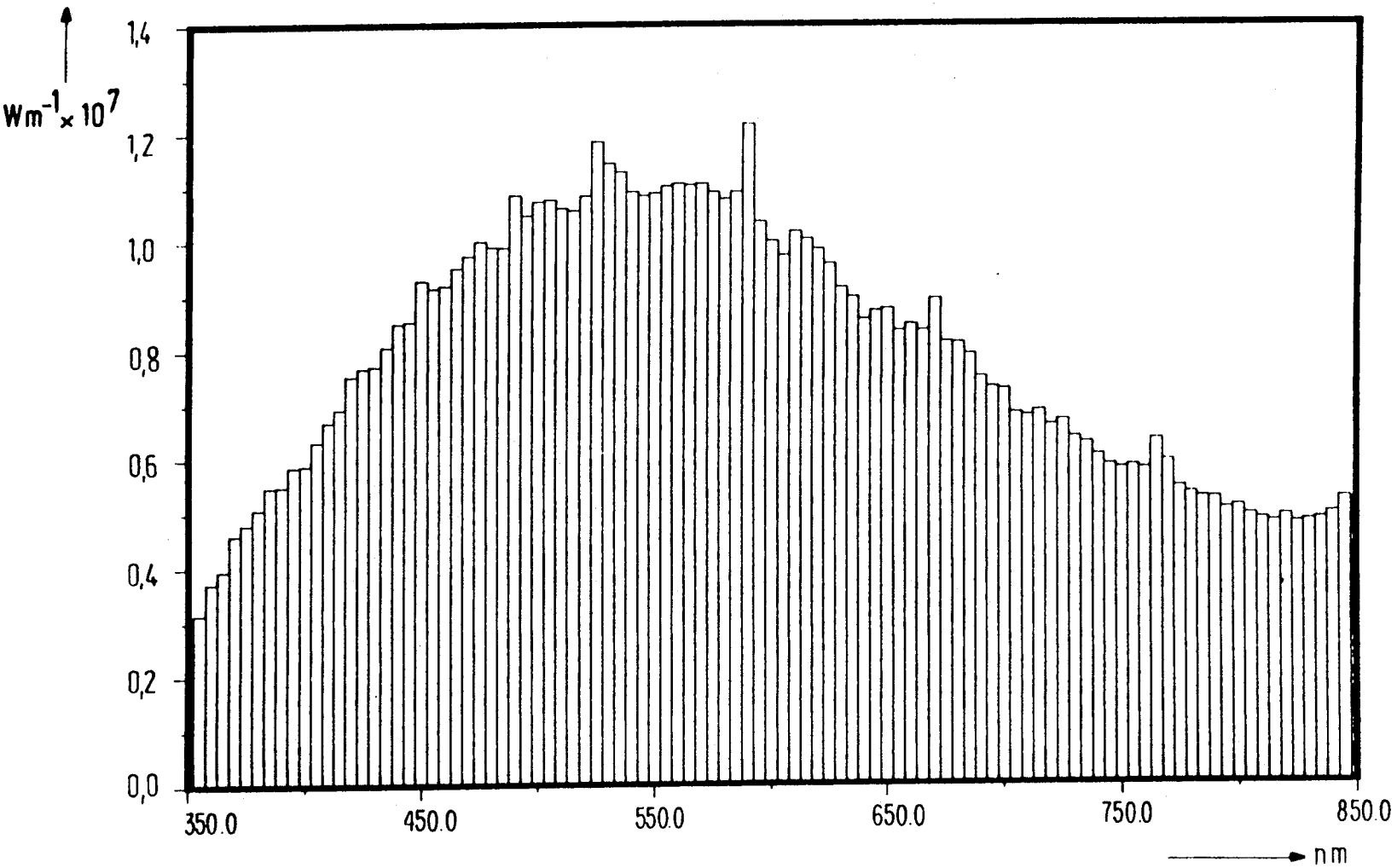

The spectrum of this lamp is shown in FIG. 4, plotted as the spectral radiant flux against the wavelength. The lamp emits a continuous spectrum, whose maximum is near the highest sensitivity of the human eye (at 555 nm wavelength). The colour temperature is practically that of daylight and the colour rendering index is almost as good as that of daylight or incandescent light. The luminous efficacy is considerably higher than that of incandescent lamps. No corrosion effects of any kind are evident in the lamp after 100 hours of operation.

EXAMPLE 7

| | |
|---|---|
| Filling | 0.45 mg $ReO_3$ |
| | 133 mbar Xe |
| Metal in gas phase | 1.4 mg/$cm^3$ Re |
| Electric power | 100 W |
| Luminous efficacy | 46 lm/W |
| Colour temperature | 5775 K |
| Colour rendering index $R_a$ | 97 |
| Wall temperture | 1045° C. |

EXAMPLE 8

| | |
|---|---|
| Filling | 0.1 mg $WO_2Br_2$ |
| | 0.01 mg CsBr |
| | 10 mbar Ar/Kr mixture |
| Metal in gas phase | 0.2 mg/$cm^3$ W |
| Electric power | 60 W |
| Luminous efficacy | 27 lm/W |
| Colour temperature | 4380 K |
| Colour rendering index $R_a$ | 92 |
| Wall temperture | 980° C. |

EXAMPLE 9

| | |
|---|---|
| Filling | 0.025 mg $WO_2Br_2$ |
| | 0.01 mg CsBr |
| | 10 mbar Ar/Kr mixture |
| Metal in gas phase | 0.05 mg/$cm^3$ W |
| Electric power | 60 W |
| Luminous efficacy | 5.5 lm/W ?? |
| Colour temperature | 3270 K |
| Colour rendering index $R_a$ | 94 |
| Wall temperture | 1090° C. |

EXAMPLE 10

| | |
|---|---|
| Filling | 0.1 mg $Re_2O_7$<br>133 mbar Xe |
| Metal in gas phase | 0.03 mg/cm³ Re |
| Electric power | 80 W |
| Luminous efficacy | 43 lm/W |
| Colour temperature | 5750 K |
| Colour rendering index $R_a$ | 96 |
| Wall temperture | 1050° C. |

EXAMPLE 11

The lamp used where corresponds to that according to FIG. 2.

| | |
|---|---|
| Filling | 1.5 mg $WO_2Br_2$<br>0.1 mg CsBr<br>10 mbar Ar/Kr mixture |
| Metal in gas phase | 0.5 mg/cm³ W |

The characteristics of this lamp in various burning positions, i.e. for various angle a between the discharge arc and the vertical, are presented in Table I. The microwave power input is 120 W.

TABLE I

| | a | | |
|---|---|---|---|
| | 0° | 45° | 90° |
| e (lm/W) | 65.0 | 65.3 | 64.5 |
| x | 0.339 | 0.336 | 0.336 |
| y | 0.345 | 0.343 | 0.343 |
| $T_c$ (K) | 5208 | 5363 | 5347 |
| $R_a$ | 93.3 | 93.4 | 93.6 |

Table II shows the lamp behaviour during dimming.

TABLE II

| | | | | | | | |
|---|---|---|---|---|---|---|---|
| P (W) | 36 | 55 | 73 | 91 | 108 | 126 | 155 |
| F (klm) | 1.77 | 2.99 | 4.23 | 5.48 | 6.89 | 8.13 | 9.33 |
| e (lm/W) | 49.29 | 54.4 | 58.0 | 60.2 | 63.8 | 64.5 | 60.2 |
| $T_c$ (K) | 5020 | 5420 | 5575 | 5470 | 5400 | 5105 | 4755 |
| $R_a$ | 91.6 | 92.7 | 93.2 | 93.3 | 93.0 | 93.0 | 93.0 |
| $T_w$ (°C) | 500 | 560 | 610 | 655 | 680 | 720 | 780 |

Legend
P excitation power of microwave field
F luminous flux
E luminous efficacy
$T_c$ colour temperature
$R_a$ colour rendering index
$T_w$ wall temperature
x,y chromaticity coordinates
a angle between discharge arc and vertiel It can be seen from Table I that the photometric characteristics of this lamp are practically independent of its burning position, i.e. of the angle between the discharge arc and the vertical. Table II shows that the luminous flux of the lamp can be dimmed down to 20% of its maximum value without the colour characteristics and the luminous efficacy of the lamp being substantially changed.

The good colour rendering characteristics of all lamps according to the embodiments can be explained from the fact that —just as is the case in an incandescent lamp —the mechanism for generating the radiation is based on the thermal emission by a liquid or solid body. The luminous efficacies and lives of these lamps are even better than those of incandescent lamps because the temperature of the radiating particles is higher than that of conventional incandescent bodies.

In all lamps according to the embodiments, the radiation is generated by incandescence of small particles of tungsten, rhenium or tantalum, which are produced in the high pressure gas discharge in the following way. The metal is introduced into the quartz glass bulb in the form of chemical compounds (halides, oxyhalides, or oxides), which already have high vapour pressures at wall temperatures which the bulb material is able to sustain. In order to heat up the discharge vessel to the operating temperature at the start, a discharge is first ignited by the high-frequency field in the starting gas which has also been introduced into the bulb. The metal compounds will evaporate when the wall temperature has become sufficiently high. The metal brought into the gas phase is bound in compounds in the vicinity of the bulb wall, but these compounds dissociate the moment they enter the discharge through diffusion or convection. The result is that elementary metal is freed and a supersaturated metal vapour is produced, from which metal particles condense. These metal particles generate an incandescent radiation at a temperature of 3000–4500 K. Any particles which leave the discharge through diffusion or convection are chemically bound again. Thus a regenerative cycle of condensation and dissolution takes place in which no material is used up or lost.

The chemical system in which the particles are produced and dissolved fixes a temperature range within which particles can exist. This temperature determines the spectrum of the incandescent radiation, which means that this spectrum is independent of lamp power, burning position and exact lamp filling quantities.

In the embodiments discussed the metal particles are smaller than 10 nm, so much smaller than the wavelength of visible light (380 nm to 780 nm). The optical characteristics of such small particles, or clusters, are clearly different from those of larger bodies of the same composition, causing a stronger presence of the blue light in the incandescent spectrum compared with the red light and heat radiation. Thanks to these special characteristics, the embodiments discussed above offer a further deviation of the lamp spectrum from that of traditional incandescent lamps, which deviation is favourable for light production.

We claim:

1. A high pressure gas discharge lamp having a bulb enclosing a volume and a filling in said bulb which contains a starting gas and a metal compound in such a quantity that in the operational condition of the lamp condensed metal particles are formed which generate light by incandescent emission, characterized in that:

(no underlining) the lamp has no electrodes and contains a metal compound chosen from the group consisting of halides of tungsten, rhenium and tantalum, oxihalides of tungsten, rhenium, and tantalum, and rhenium oxide, the quantity of metal in said bulb being at least 0.002mg/cm$^3$ of bulb volume in the case of a tungsten or rhenium compound, and at least 0.4 mg/cm$^3$ in the case of a tantalum compound.

2. A high pressure gas discharge lamp as claimed in claim 1, characterized in that;

said filling contains further metals or metal compounds.

3. A high pressure gas discharge lamp as claimed in claim 1, characterized in that;

said filling contains a rare gas or rare gas mixture with a filling pressure at room temperature of more than 20 mbar.

4. A high pressure gas discharge lamp as claimed in claim 1, characterized in that;

said filling consists of rhenium heptoxide and xenon, the xenon filling pressure at room temperature being greater than 20 mbar.

5. An electrodeless high pressure discharge lamp, comprising:

a discharge vessel sealed in a gas-tight manner and enclosing a predetermined volume;

a filling in said discharge vessel comprising a starting gas and a metal compound chosen from the group consisting of tungsten halide, rhenium halide, tantalum halide, tungsten oxihalide, rhenium oxihalide, tantalum oxihalide, and rhenium oxide, said metal compound being present in said discharge vessel in a quantity of at least 0.02 mg/cm$^3$ of discharge vessel volume for said metal compounds of tungsten and rhenium and at least 0.4 mg/cm$^3$ of discharge vessel volume for said metal compounds of tantalum; and means for energizing said filling within said discharge vessel to form condensed metal particles which generate radiation by incandescent emission.

6. A high pressure gas discharge lamp as claimed in claim 5, wherein said filling contains further metals or metal compounds.

7. A high pressure gas discharge lamp as claimed in claim 5, wherein said filling contains a rare gas or rare gas mixture with a filling pressure at room temperature of more than 20 mbar.

8. A high pressure gas discharge lamp as claimed in claim 5, wherein said filling consists of rhenium heptoxide and xenon, the xenon filling pressure at room temperature being greater than 20 mbar.

* * * * *